United States Patent [19]

Funari

[11] Patent Number: 4,986,044

[45] Date of Patent: Jan. 22, 1991

[54] ADJUSTABLE DOOR FRAME

[75] Inventor: Michael A. Funari, Erie, Pa.

[73] Assignee: Fenestra Corporation, Erie, Pa.

[21] Appl. No.: 381,041

[22] Filed: Jul. 17, 1989

[51] Int. Cl.[5] ..... E06B 1/04

[52] U.S. Cl. ..... 52/213; 52/211; 52/217

[58] Field of Search ..... 52/217, 211, 213, 214, 52/215

[56] References Cited

U.S. PATENT DOCUMENTS

| | | | |
|---|---|---|---|
| 1,048,988 | 12/1912 | Mayo, Sr. | 52/212 |
| 2,214,947 | 9/1940 | Wetzel | 52/211 X |
| 2,853,161 | 9/1958 | Mascari | 52/217 X |
| 3,420,003 | 1/1969 | Cline | 52/217 X |
| 4,735,025 | 4/1988 | Day | 52/217 |
| 4,791,758 | 12/1988 | Bauer et al. | 52/212 X |
| 4,813,204 | 3/1989 | Rentschler . | |
| 4,912,879 | 4/1990 | Mozuras et al. | 49/505 |

FOREIGN PATENT DOCUMENTS

| | | | |
|---|---|---|---|
| 830274 | 3/1960 | United Kingdom | 52/214 |

*Primary Examiner*—David A. Scherbel
*Assistant Examiner*—Linda J. Hoffert
*Attorney, Agent, or Firm*—Charles L. Lovercheck; Wayne L. Lovercheck; Dale R. Lovercheck

[57] ABSTRACT

An adjustable door jamb assembly which can be simply and accurately aligned and installed in a door opening. The jamb assemblies are each made up of a fixed section and an adjustable section. Each fixed section has a plurality of snap-in guide clips supported thereon. The clips each have a plate-like body with a leg at each end and an integral cantilever tongue extending generally parallel to, but converging toward, the plate-like body of the clip so that the tongue is deflected away from the plate-like body. A flange on the adjustable section is received between the cantilever tongue and one of the legs. The tongue of each clip frictionally engages the adjustable section holding it in adjusted position on the door jamb.

6 Claims, 2 Drawing Sheets

ADJUSTABLE DOOR FRAME

BACKGROUND OF THE INVENTION

This invention relates to door frames, and more particularly to adjustable door frames.

REFERENCE TO PRIOR ART

Adjustable door frames have been provided wherein two jamb sections are held in adjustable relation to one another by means of pins fixed to one section and frictionally received in sockets in another section. The pin and socket arrangement has limited movement and has various other disadvantages. An example of such a frame is shown in U.S. Patent No. 4,813,204.

Applicant has provided an adjustable door frame having jamb sections that are adjustable with relation to each other, which are held in position by snap-in guide clips. The clips are suppored on one part of the frame and slidably and frictionally engage the other part of the frame. The clips are easy to assemble, economical to manufacture and simple and efficient to use. The clips have greater frictional force holding the frame parts together than is possible with the prior art.

OBJECTS OF THE INVENTION

It is an object of the invention to provide an improved adjustable door frame. Another object of the invention is to provide a door frame with a fixed section and a movable section, held together by means of snap-in guide clips that frictionally receive a casing flange on the movable section.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DETAILED DESCRIPTION OF THE DRAWINGS

Figure 1:
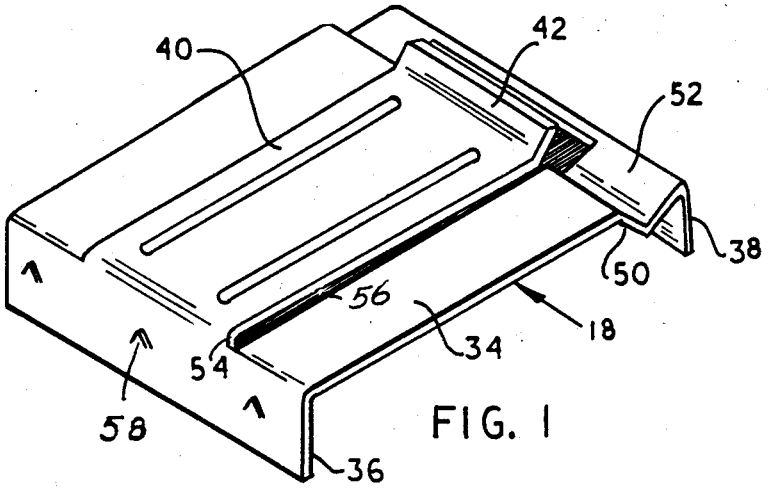
FIG. 1 is an isometric view of the snap-in guide clip used in a door frame according to the invention.

Now with more particular reference to the drawings, I show an adjustable door frame 10 for a door opening 11. Frame 10 has first side frame section 13 and second side frame section 17, header 15 and sil 19. Header 15, first side frame section 13 and second side frame section 17 have fixed frame section 14 and sliding frame section 16.

Fixed frame section 14 may be made of a single sheet of metal having first jamb flange 20 bent at right angles to first part 24 of first casing flange 22. First casing flange 22 has first part 24 and second part 28 that are disposed in spaced generally parallel relation to one another and integrally connected together by stop flange 26. Stop flange 26 is bent at right angles to first part 24 and generally parallel to first jamb flange 20. Second part 28 of first casing flange 22 is bent at right angles to stop flange 26 and generally parallel to first part 24 of first casing flange 22. Clip support flange 30 is integrally attached to second part 28 of first casing flange 22 and is disposed parallel to stop flange 26. Clip support flange 30 is bent at right angles to second part 28 of first casing flange 22 and generally parallel to stop flange 26. End flange 32 is integrally attached to clip support flange 30 and is disposed generally parallel to second part 28 of first casing flange 22. Stop flange 26, second part 28 of first casing flange 22, clip support flange 30 and end flange 32 define space 44 which receives guide clip 18.

A plurality of guide clips 18 are supported on fixed frame section 14. Each guide clip 18, may be made of one plate-like piece of sheet metal. Each clip has generally flat body part 34, first leg 36 integrally attached to body part 34, and second leg 38. Second leg 38 is generally parallel to leg 36. Second leg 38 is integrally connected to body part 34 by means of first connecting member 50 and second connecting member 52. First conecting member 50 and second connecting member 52 are bent relative to one another which gives clips 18 more resiliency.

Figure 3:
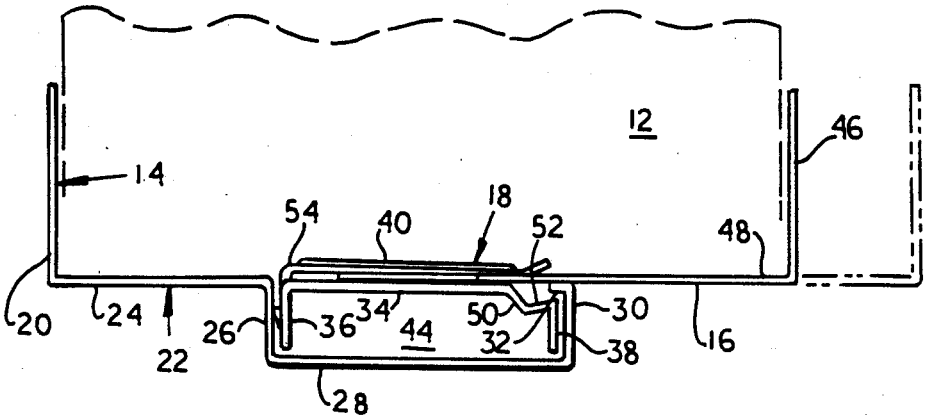
FIG. 3 is typical sectional view of the door frame parts showing the sliding frame section prior to adjustment in phantom and in adjusted position in full lines.
Figure 4:
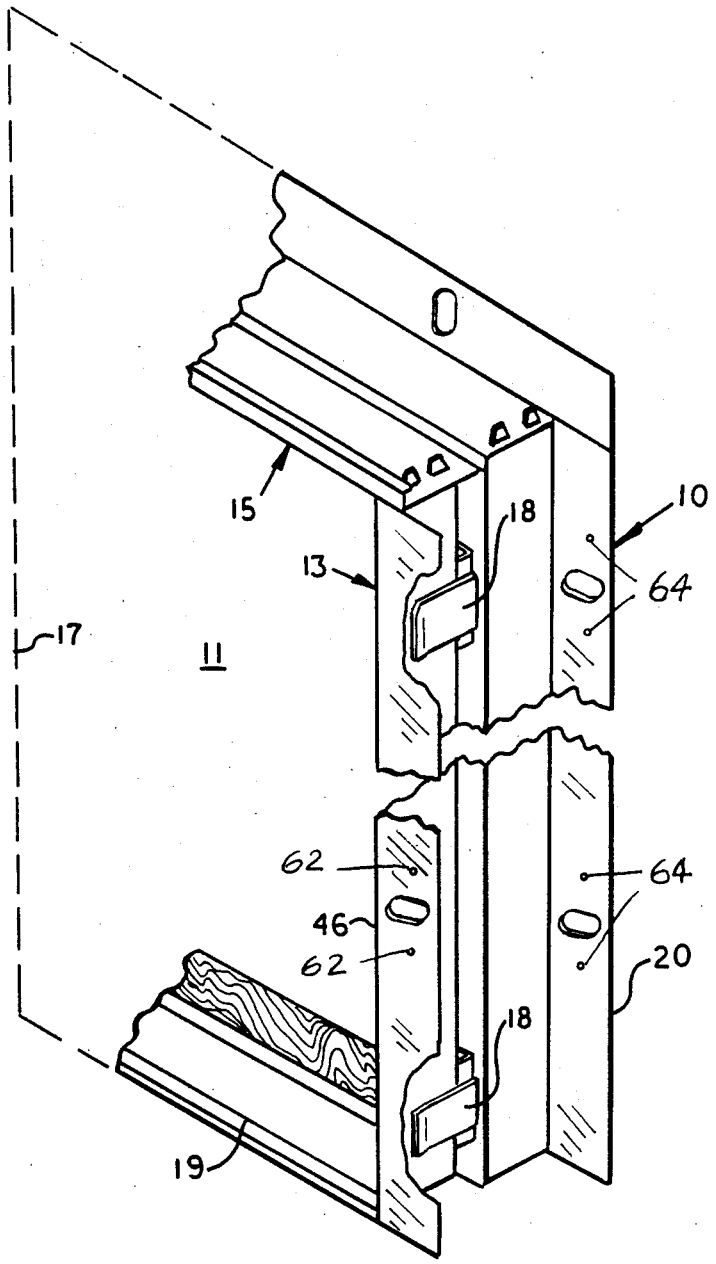
FIG. 4 is an isometric view illustrating the relationship of the various components of the invention.

Tongue section 40 may be struck out from body 34, leaving recess 56. Tongue 40 has distal end 42 which is integrally attached to third connecting member 54, which is integrally attached to first leg 36. Tongue 40 is generally parallel to body 34 but inclines from third connecting member 54 toward body 34. Thus, tongue section 40 is resiliently urged toward body 34 so that when second casing flange 48 is forced between tongue 40 and body 34, in the position shown in full lines in FIG. 3, tongue 40 is resiliently held toward second casing flange 48 and frictionally holds sliding frame 16 in position. Spaced detents 58 are struck out from first leg 36 and engage stop flange 26 to resist sliding of clips 18 in space 44.

Sliding frame section 16 has jamb section 46 and second casing flange 48 integrally connected thereto and disposed perpendicular to jamb section 46. Jamb section 46 is intended to rest along the outside of a door jamb while second casing flange 48 is slidably received between tongue 40 and body 34 of clip 18 along side the recess left by tongue 40, thereby frictionally holding jamb section 46 in fixed parallel spaced relation to first jamb flange 20. First jamb flange 20 may be attached to wall 12, defining opening 11. First jamb flange 20 has first holes 64 and jamb section 46 has second nail holes 62 to mount jamb section 46 to wall 12.

In practice, two or more guide clips 18 are spaced vertically in space 44. The number of clips 18 is determined by the installer of the door frame, as recommended by the manufacturer or the designer. First leg 36, of each clip 18, will be disposed in close parallel relation to stop flange 26 with detents 58 in engagement with stop flange 26. Second leg 38 will be disposed under end flange 32 and adjacent clip support flange 30. Body part 34 of each guide clip 18 will extend generally parallel to second part 28 of casing flange 22. Therefore, second casing flange 48 will be frictionally held generally in parallel relation to first casing flange 22. The resiliency of tongue 40 will urge tongue 40 toward body part 34 of clip 18. Therefore, second casing flange 48 will be held in position relative to casing flange 22 with first jamb flange 20 and jamb section 46 snugly engaging the sides of wall 12.

Figure 2:
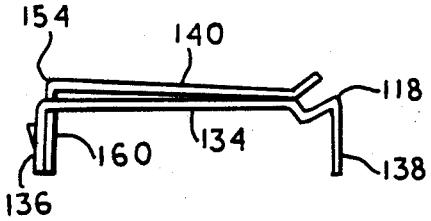
FIG. 2 is a view similar to FIG. 2A of another embodiment of the invention.
Figure 2A:
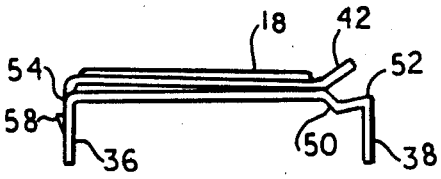
FIG. 2*a* is an end view of the clip shown in FIG. 1.

In the embodiment of the invention shown in FIG. 2, tongue 140 of clip 118 is a separate part from first leg 136 and has third leg 160 spot welded to first leg 136. Third leg 160 is integrally attached to tongue 140 at position 154. Tongue 140 extends generally parallel to body 134.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. An adjustable door frame comprising a first side frame section and a second side frame section, said first side frame section comprising a fixed frame section and a sliding frame section, a header means attached to said first side frame section and said second side frame section, said fixed frame section having a first jamb flange and a first casing flange, said sliding frame section having a second jamb section and a second casing flange integrally connected together, said first casing flange comprising a first part and a second part being disposed generally in parallel planes adjacent one another, vertically spaced guide clips supported on said fixed frame section, friction means on said guide clips holding said guide clips in position, said guide clips having a plate-like body made of resilient material, the ends of said plate-like body being bent generally at right angles relative to said body defining spaced legs adapted to rest on said frame section, a tongue integrally attached to said body adjacent one said leg defining a space between said tongue and said body and extending in cantilever fashion on the side of said body opposite said legs and generally parallel to and inclined toward said plate-like body to a position adjacent the other said leg, said tongue engaging said second casing flange and said second casing flange and adapted to slidably and snugly receive said second casing flange in said space between said tongue and said body wherreby said second casing flange is held in position parallel to said first casing flange on said fixed frame section whereby said tongue frictionally engages said second casing flange and said second casing flange is frictionally held in adjusted position parallel to said first casing flange on said fixed frame section.

2. The adjustable door frame recited in claim 1 wherein said side frame sections and said header means are connected together and each is one similar cross section to the other.

3. An adjustable door frame for a door opening having two side frames and a header, each said side frames comprising a fixed frame section and a sliding frame section, a plurality of guide clips, said fixed frame section having a first jamb flange adapted to be attached to a wall, each said side frame having a first casing flange, said first casing flange being made up of a first part integrally attached to said jamb flange and extending generally perpendicular thereto, a stop flange fixed to said first part of said casing flange and extending perpendicular thereto, a second part of said casing flange fixed to said stop flange and extends parallel to said first part, a clip supporting flange integrally fixed to said second part of said casing flange and extending perpendicular to said second part of said casing flange, an end flange integrally attached to said clip supporting flange and extending generally parallel to said second part of said casing flange, said stop flange, said second part of said casing flange, said clip support flange and said end flange defining a clip receiving space, receiving said casing flange, said guide clips each comprising a generally flat body part having a first end bent at right angles to said body part forming a first leg and a second end bent at right angles to said body part and forming a second leg integrally attached to said body part and extending generally parallel to said body part, said clips being received in said clip receiving space with said first leg of said body part and said second leg of said body part resting on said second part of said casing flange, a tongue integrally attached to said body part adjacent said first leg and extending in cantilever fashion from said first leg generally parallel to said body part defining a space between said body part and said tongue for snugly receiving an end of said sliding frame section, said sliding frame section substantially rests on said body part, said tongue being adapted to frictionally engage and hold said sliding frame section in place.

4. An adjustable door frame comprising a first side frame section and a second side frame section, said first side frame section comprising a fixed frame section and a sliding frame section, a header means attached to said first side frame section and said second side frame section, said fixed frame section having a first jamb flange and a first casing flange, said sliding frame section having a second jamb section and a second casing flange integrally connected together, said first casing flange comprising a first part and a second part being disposed generally in parallel planes adjacent one another, vertically spaced guide clips supported on said fixed frame section, said guide clips having a plate-like body, a flange engaging means resiliently attached to said body defining a space, said flange engaging means slidably receiving said second casing flange on said sliding frame section, said flange engaging means slidably receiving said second casing flange whereby said second casing flange is held in position parallel to said first casing flange on said fixed frame section, said guide clips are formed of a flat plate having its ends bent at right angles to an intermediate part of said plate forming a body part, a first leg and a second leg, an opening in said body part extending substantially from one said leg to the other, said flange engaging means being fixed to said first leg and disposed generally parallel to said body part and spaced therefrom defining a space between said body part and said flange engaging means, said second casing flange being adapted to be received between said body part and said flange engaging means and frictionally held therein by said flange engaging means.

5. The frame recited in claim 4 wherein said flange engaging means has an end extending at an acute angle to said body, said flange engaging means being adapted to engage an end of said second casing flange for guiding said casing flange to a position between said flange engaging means and said body.

6. The frame recited in claim 5 wherein said body is bent away from said flange engaging means at a position adjacent said flange engaging means providing a recess to receive said second casing flange to guide said casing flange to a position between said flange engaging means and said body.

* * * * *